US005433827A

United States Patent [19]

Page et al.

[11] Patent Number: 5,433,827

[45] Date of Patent: Jul. 18, 1995

[54] METHOD FOR THE DEACIDIFICATION OF PAPERS AND BOOKS

[75] Inventors: Derek H. Page; Anthony M. Scallan; Steven R. Middleton; Xuejun Zou, all of Pointe Claire, Canada

[73] Assignee: Pulp and Paper Research Institute of Canada, Pointe Claire, Canada

[21] Appl. No.: 170,894

[22] Filed: Dec. 21, 1993

[51] Int. Cl.[6] ..... D21H 25/18; D21H 25/02

[52] U.S. Cl. ..... 162/160; 162/181.5; 427/343; 427/342

[58] Field of Search ..... 162/160; 427/339, 180, 427/343, 248.1; 422/1, 32; 252/380, 383, 384, 397, 399

[56] References Cited

U.S. PATENT DOCUMENTS

| | | | |
|---|---|---|---|
| 2,033,452 | 3/1936 | Schierholtz | 162/160 |
| 3,472,611 | 10/1969 | Langwell | 427/248.1 |
| 3,676,182 | 7/1972 | Smith | 427/316 |
| 3,771,958 | 11/1973 | Kusterer, Jr. et al. | 427/248.1 |
| 3,898,356 | 8/1975 | Williams et al. | 427/343 |
| 3,939,091 | 2/1976 | Kelly, Jr. | 252/189 |
| 3,969,549 | 7/1976 | Williams et al. | 427/248 |
| 4,051,276 | 9/1977 | Williams et al. | 427/255.3 |
| 4,522,843 | 6/1985 | Kundrot | 427/475 |
| 4,863,566 | 9/1989 | Warren et al. | 162/160 |
| 5,104,997 | 4/1992 | Kamienski et al. | 556/130 |
| 5,219,524 | 6/1993 | Evans, II | 422/40 |
| 5,322,558 | 6/1994 | Wiltekind et al. | 106/257.24 |

OTHER PUBLICATIONS

Barrow, W. J., "Deacidification and Lamination of Deteriorated Documents", American Archivist 28, 285–290 (1965).

W. J. Barrow Research Laboratory, "Permanence/-Durability of the Book", Dietz Press Inc., Richmond, Va., pp. 22–27 (1963).

Baynes-Cope, A. D., "The Non Aqueous Deacidification of Documents", Restaurator 1(1) 2–9 (1969).

Kozak, J. J. and Spatz, R. E., "Deacidification of Paper by the Bookkeeper Process in Paper Preservation", TAPPI Press, Ed. P. Luner (1990).

Baum, G. A., "Electrical Properties: I. Theory" in Handbook of Physical and Mechanical Testing of Paper and Paperboard, Ed. R. Mark, Marcel Dekker, New York pp. 175–178 (1984).

Adamson, A. W., "Physical Chemistry of Surfaces" 3rd Edition, John Wiley & Sons, New York, pp. 51–52 (1976).

Neale, S. M. and Stringfellow, W. A., "The Determination of the Carboxylic Acid Group in Oxycelluloses", Trans, Faraday Soc., 31:881 (1937).

Smith, R. D., "Deacidification Technologies—State of the Art" in Paper Preservation, TAPPI Press, Ed. P. Luner (1990).

*Primary Examiner*—W. Gary Jones
*Assistant Examiner*—Jose A. Fortuna
*Attorney, Agent, or Firm*—Swabey Ogilvy Renault

[57] ABSTRACT

Acidic papers, books, and other sheets of cellulosic material may be deacidified and so given a prolonged life by bringing the papers, books, or other sheets of cellulosic material to be treated in intimate contact with a source of solid alkali such as calcium carbonate filled paper, at an elevated humidity and under mechanical pressure for a period long enough to produce deacidification; the process differs from other processes in that it is carried out in the solid state without the use of liquid or gaseous reactants.

25 Claims, 3 Drawing Sheets

METHOD FOR THE DEACIDIFICATION OF PAPERS AND BOOKS

BACKGROUND OF THE INVENTION

1. Field of the Invention

The conservation of paper and other cellulosic materials has importance for libraries and for archives. Paper deteriorates mechanically primarily because of either the intrinsic acid nature of the pulp, or the introduction of acids during processing. Over time, the acid promotes hydrolysis of the cellulose, reducing its strength and causing embrittlement. The neutralization or deacidification of paper has been seen as a necessary requirement for lengthening the useful life of paper that is initially acidic.

2. Description of the Prior Art

Various methods have been proposed for the deacidification of paper. The simplest consists of the immersion of the paper in an aqueous solution of alkali, followed by drying, as described in U.S. Pat. No. 2,033,452, Schierholtz, O. J., and Barrow, W. J., "Deacidification and Lamination of Deteriorated Documents", American Archivist 28,285–290 (1965). Aqueous alkaline sprays have also been proposed by W. J. Barrow Research Laboratory, "Permanence/Durability of the Book", Dietz Press Inc., Richmond, Virginia, p.22 (1963). Both these methods suffer from the problem of requiring the handling of sheets in the wet state, with the consequent risk of damage, as well as introducing effects such as curl and cockle caused by uneven wetting and drying. To overcome this, various non-aqueous solvent treatments have been proposed. The earliest of these is a treatment with a solution of barium hydroxide in methanol developed by Baynes-Cope, "The Non Aqueous Deacidification of Documents", Restaurator 1(1) 2–9 (1969). Smith in U.S. Pat. No. 3,676,182 discloses a method of using a magnesium alkoxide in an organic solvent such as alcohol or a Freon (Trade Mark for fluorocarbons). Kelly in U.S. Pat. No. 3,939,091 discloses a method using methyl magnesium carbonate in methanol or a halogenated hydrocarbon. Kaminski and Wediger in U.S. Pat. No. 5,104,997 discloses a method using magnesium or zinc alkoxides dissolved in various hydrocarbon or halocarbon solvents. Williams and Kelly in U.S. Pat. No. 4,051,276 discloses a treatment using certain organo-metallic compounds, specifically diethyl zinc, in an organic solvent. Kundrot in U.S. Pat. No. 4,522,843 discloses a method of treatment using particles of inorganic alkaline hydroxides or carbonates dispersed in air or in Freon.

Gaseous methods have also been proposed. The simplest, neutralization with ammonia, is described by Barrow, above, and is claimed not to be effective. While a pH of an originally acid paper could be brought to neutrality using ammonia vapor, the deacidification was temporary presumably because of the volatility of ammonia and its weak alkalinity. The paper became acid again after a few weeks. Other stronger less volatile alkalis have been proposed such as morpholine disclosed by Kusterer and Sproull in U.S. Pat. No. 3,771,958. Langwell in U.S. Pat. No. 3,472,611 discloses a treatment in which a carbonate or acetate of one of the amines such as cyclohexamine is prepared and deposited on paper which is interleaved between the sheets to be treated. As the salt slowly decomposes, the cyclohexamine vapor is made available to the paper and neutralizes it over a period of weeks. It is part of the disclosure that the cyclohexamine salt does not need to be in contact with the paper to be treated since the transmission of the cyclohexamine occurs through the vapor phase.

Although some of these methods are in use, none has been widely accepted. There is uncertainty that the treatments are entirely benign especially towards the adhesives, the bindings and the printing inks. Moreover some of the treatments use chemicals that are increasingly suspect as health hazards, or as threats to the environment, as described by Smith, R. D., "Deacidification Technologies—State of the Art", in "Paper Preservation", TAPPI Press, Ed. P. Luner (1990). Finally the treatment methods are expensive, requiring specialized treatment equipment, expensive chemicals and trained operators.

It has been known for some time that free acid in paper can migrate to paper in contact with it, under air dry conditions, as described by Kozak, J. J. and Spatz, R. E., "Deacidification of Paper by the Bookkeeper Process", in "Paper Preservation", TAPPI Press, Ed. P. Luner (1990). This occurs even when the acid is non volatile, for example sulphuric acid.

The migration of ions in air-dry paper is also known from evidence of electrical conductivity. At 50% relative humidity, paper with a moisture content of about 6% can have an electrical conductivity several orders of magnitude higher than that of bone dry paper as described by Baum, G. A., "Electrical Properties: I. Theory", in "Handbook of Physical and Mechanical Testing of Paper and Paperboard", Ed. R. Mark, Marcel Dekker, New York, p. 175–178 (1984), and this is attributed to the freedom of cations such as calcium, magnesium or sodium to migrate through the anionic, water-swollen fibres.

In a sheet of mechanical or chemical pulp, deacidification cannot be achieved simply by the migration of free acid. These pulps always contain acidic groups bound within the cell walls of the pulp, with counter ions associated with them. For deacidification to be achieved, and to meet the condition of electrical neutrality, hydrogen counter-ions must be replaced by other cations such as calcium, magnesium or sodium which must migrate into the sheet.

SUMMARY OF THE INVENTION

This invention overcomes the afore-mentioned problems in a method that deacidifies paper in an essentially air-dry state, without the use of gaseous reagents but instead using materials that are commonly available, benign and inexpensive.

In accordance with the invention there is provided a process for deacidifying acidic papers comprising: holding at least one acidic paper in an assembly with a source of an alkaline solid, said assembly being under a mechanical pressure and at an elevated humidity effective to promote migration of ions between said alkaline solid and the acid of said paper.

In accordance with another aspect of the invention there is provided a deacidification paper sheet containing at least 0.1%, by weight, of an alkaline solid. The deacidification paper sheet may additionally contain an electrolyte salt, which may function to promote the migration of the ions.

The alkaline solid is, in particular, a material which reacts with an acid to deacidify or neutralize it, and form reaction products which are benign to paper. Such materials include the carbonates and bicarbonates of alkali and alkaline earth metals, for example, sodium bicarbonate, calcium carbonate, magnesium carbonate and mixtures thereof.

Relatively weak alkaline material are preferred, for example, the carbonates.

Thus in accordance with the invention a process is provided by which paper can be deacidified in a simple way.

This process may include holding an acidic paper sheet to be treated in close contact under mechanical pressure with a sheet of paper containing calcium or magnesium carbonate or sodium bicarbonate. The moisture content both in the acidic paper sheet to be treated and in the contacting paper sheet are made sufficiently high, by using an adequately high relative humidity to allow the migration of ions across the region of contact between the two sheets.

The time taken for migration to be essentially complete depends on the moisture content of the paper, the higher the humidity the more rapid the change. The time also depends upon the pressure under which the sheets are pressed together, the higher the pressure the faster the change.

Alternatively the same effect may be achieved by dusting the paper with the alkaline solid, for example, calcium or magnesium carbonate. Neutralization of the sheet is achieved with the passage of time, depending on the moisture content of the sheet.

Completion of the deacidification is determined from the measurement of the pH of the treated paper, for example by interleaving samples of pH indicator paper, in contact with the paper being treated, but out of contact with the alkaline sheet or by using a pH indicator pen.

DETAILED DESCRIPTION OF THE INVENTION i) Deacidification

The deacidification process of the invention can be carried out in a number of ways.

One book deacidification procedure of this invention would consist of humidifying the book to a high humidity, and inserting between the pages, sheets of paper containing calcium carbonate also at a high humidity. Sheets can be placed between every page, or less frequently, depending on the acceptable length of the treatment. The book would be closed under mechanical pressure and the humidity maintained until deacidified as indicated by non-destructive tests such as indicator papers placed between the pages of the book. It is a part of this invention that while the time taken to achieve deacidification may vary from book to book and according to the relative humidity chosen, there is no danger to the book of over treatment. Once an equilibrium has been reached the book can rest safely almost indefinitely. After treatment the calcium carbonate loaded sheets can be removed and the book returned to use.

In an alternative procedure, the book may be treated at ambient air humidity, but using calcium carbonate loaded sheets conditioned to a very high humidity and rapidly interleaved between its pages. The book may then be sealed in a plastic bag and held under mechanical pressure. The moisture in the carbonate sheet redistributes throughout the book, bringing the book to a moisture content high enough for migration of the ions to occur.

In an alternative procedure, the book is simply interleaved with thin sheets containing calcium or magnesium carbonate and placed in storage under mechanical pressure. This mechanical pressure may be the pressure resulting from the weight of adjacent pages, or books. This procedure is suitable for collections of books or documents in environments that naturally experience very high humidities. Again completion of deacidification can be estimated by measurement of pH by for example, inspection of indicator papers interleaved in the book.

In an alternative procedure the humidified book is dusted with a cloud of dry particulate calcium carbonate, magnesium carbonate, or sodium bicarbonate, closed and stored pressed, under mechanical pressure, as before.

Loose paper sheets may be treated in a manner similar to that described for books.

It is considered important in conservation science to ensure that not only is deacidification achieved but that an acid neutralizing reserve is introduced. While this may be achieved by dusting of acid neutralizing material onto the sheet only a small reserve will be transferred by contact with carbonate-containing paper. A method of providing this reserve is to insert some carbonate-containing sheets permanently into a book.

A sheet of acid paper generally requires of the order of 0.1–1% by weight of calcium carbonate to neutralize it. Since calcium carbonate containing papers are readily made with a carbonate filler content of 20% or even higher, each sheet is capable of deacidifying many pages. The calcium carbonate sheets may therefore either be placed infrequently in the book, or if placed frequently, may be used many times. When exhausted they can be recycled as clean white waste.

A major advantage of the process over earlier processes is the use of totally innocuous or benign materials and conditions. The risk of damage to the book is negligible and this is an important aspect for rare and valuable books. The work can be carried out by workers not specifically trained in handling chemicals. In addition paper containing calcium carbonate is widely available, and inexpensive.

The humidity employed in the process of the invention is preferably at least 75%, more preferably greater than 90%, and most preferably about 97%.

The mechanical pressure is preferably at least 0.1 psi, more preferably at least 1 psi, still more preferably at least 10 psi and most preferably at least 50 psi. It will be understood that the mechanical pressure should not be so high as to damage fragile or aged papers.

It is probable that migration of ions across the interface between papers is facilitated by the formation of a continuous pathway resulting from the condensation of water in small capillaries at the contact regions, in accordance with the Kelvin equation:

$$RT \ln (P/P^{\circ}) = 2\gamma V/r$$

in which P° is the normal vapor pressure of the liquid, P is the vapor pressure over a curved surface, T is the temperature, V is the molar volume of water, r is the radius of the curved surface, and $\gamma$ is the surface tension.

The alkaline solid should be present in an amount of at least 0.1% , by weight, and generally at least 0.1 to 1%, by weight, of the deacidifying paper sheet, to effect deacidification. Of course, the deacidifying paper sheet may contain much higher amounts of the alkaline solid, such that it can be subjected to repeated use.

ii) Measurement of Deacidification

The progress of deacidification is evaluated in the following way. A sample of paper is dispersed in deionized water and the pH of the paper is measured according to the standard test of TAPPI (T 509 OM-88). Solid sodium chloride is then added so as to raise the average concentration of the liquor to 0.1 molar and the pH is remeasured (hereafter referred to as the "salt pH"). The acid content of the paper is then measured by titration of the same suspension with 0.01 molar sodium hydroxide. The amount of alkali required to reach pH 7.5 is used to calculate the acid content of the paper in the units of milliequivalents per kilogram of dry paper. On occasion the surface pH of a paper is measured using the TAPPI test (T 529 OM-88) but using 0.1M sodium chloride instead of deionized water. However, even in the presence of salt, this measurement reads somewhat high and less reproducibly than the other tests-probably due to inadequate mixing of the liquid with the fibres. Nevertheless, it is a non-destructive test and is therefore frequently used by conservationists.

The presence of a neutral salt, such as sodium chloride as described above, is essential for accurate evaluation of the acidity of cellulosic fibres. In aqueous suspensions of fibres of low ionic strength, the hydrogen ions are much more concentrated inside the fibre walls than in the external liquor and the pH of the suspension as measured in the external liquor is erroneously high as a measure of the total acid present. The addition of sufficient salt makes the hydrogen ions more evenly distributed between the fibre walls and the external solution and this, in turn, leads to a realistic evaluation of acid content as determined by pH measurement and by titration. The use of salt in titrations of cellulose fibres was first suggested by Neale and Stringfellow in "The Determination of the Carboxylic Acid Group in Oxycelluloses", and it has been subsequently adopted by most workers. The importance of salt during titration or pH measurement is still not appreciated by all workers on the conservation of papers.

EXAMPLES

EXAMPLE 1

A red litmus paper was placed in contact with a paper containing calcium carbonate filler and held under a pressure of 10 psi. Both papers had previously been conditioned at a relative humidity of 85% and this humidity was maintained. In one day the red litmus paper turned blue indicating its deacidification by ions originating from the alkaline sheet.

EXAMPLE 2

Example 1 was repeated except that the relative humidity was 50%. The litmus paper failed to turn blue even after two months demonstrating the very strong effect of relative humidity on the time needed to achieve deacidification.

EXAMPLE 3

Figure 1:
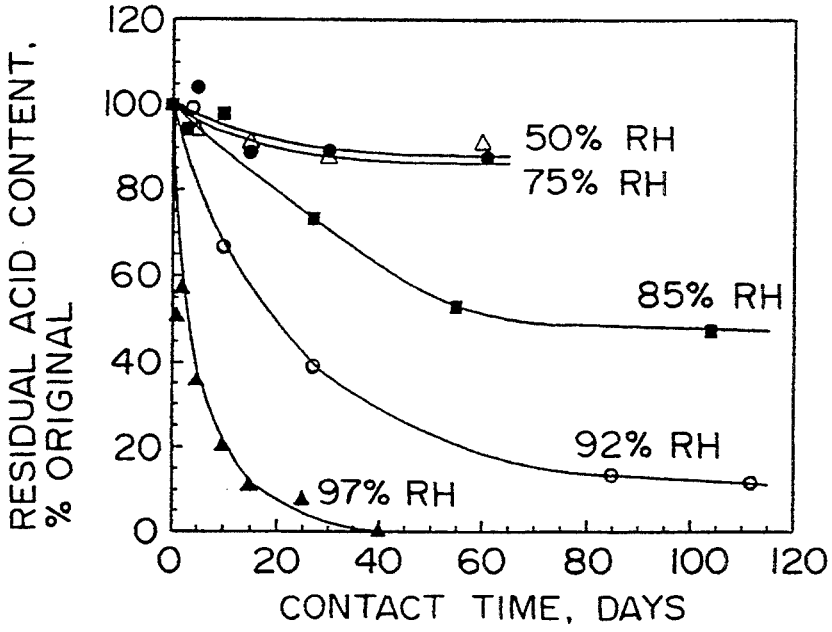
FIG. 1 demonstrates graphically the effect of relative humidity on the deacidification of handsheets of unbleached kraft pulp (1 psi, 2 side contact).

Piles of sheets were constructed consisting of a handsheet of unbleached kraft pulp sandwiched between two sheets of commercial paper containing 20% calcium carbonate. All sheets in any given pile had previously been conditioned at a certain humidity and this humidity was maintained by confining each pile to a sealed plastic bag. The piles were then pressed at 1 psi. At various times, sheets were removed from the piles and were titrated by the procedure already described. The original acid content was 46 meq/kg and FIG. 1 shows in a quantitative manner the fraction to which this acid content was reduced at various humidities. The rate of deacidification is slow at 50%—a barely resolvable decrease in acid content being observed in 30 days. The rate is however increased as the humidity is raised especially to humidities in excess of 75%. At 97% RH, the residual acid content was 10% after 15 days and 0% after 40 days.

EXAMPLE 4

Figure 2:
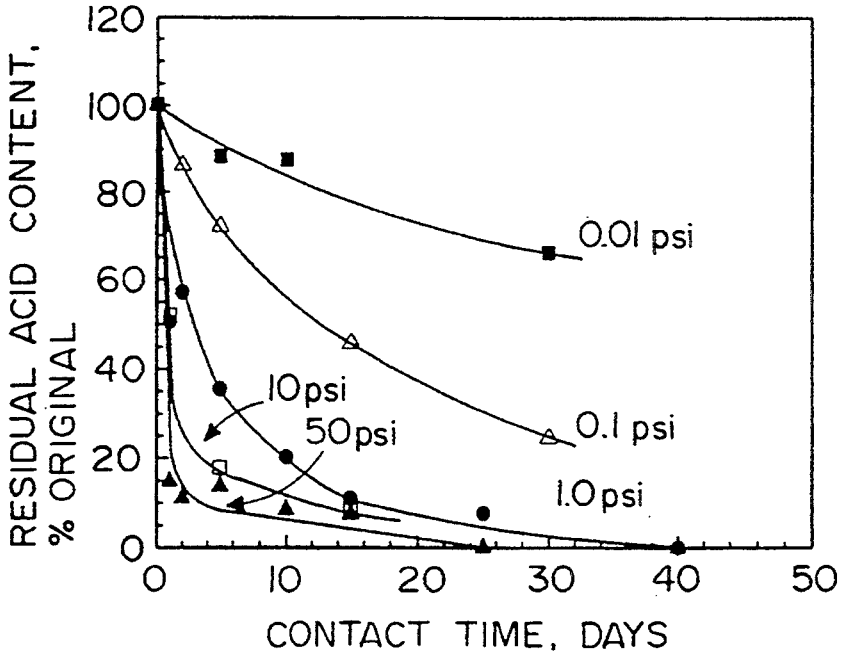
FIG. 2 demonstrates graphically the effect of pressure on the deacidification of handsheets of unbleached kraft pulp (RH 97%, 2 side contact).

Piles of sheets were constructed as described in the previous example except that the humidity of all piles was 97% and the pressure was varied from pile to pile within the range of 0.01 to 50 psi. The rate of deacidification was evaluated as in the previous example and found to be very dependent on pressure. The results are shown in FIG. 2. The original acid content of 46 meq/kg was reduced to 10% of this value after 2 days at 50 psi, after 10 days at 10psi and after 15 days at 1 psi. At these same times, the salt pH had risen from 4.0 to over 6.0 in all cases. At the other extreme, at 0.01 psi the acid content was still 70% of the original value after 30 days.

EXAMPLE 5

Figure 3:
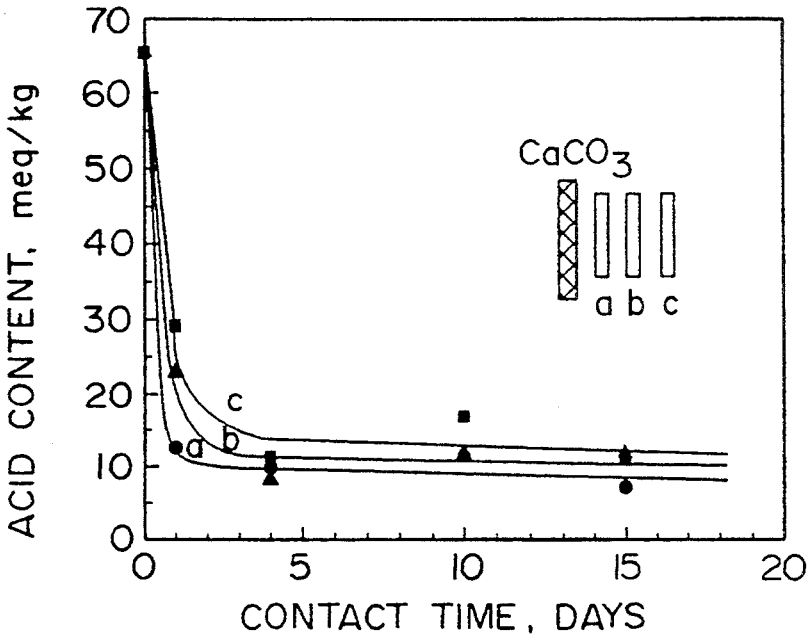
FIG. 3 demonstrates graphically the deacidification of a pile of three sheets of newsprint by one alkaline sheet (RH 97%, 50 psi).

Piles of sheets were constructed consisting of three sheets of commercial newsprint above one sheet of commercial paper containing 20% calcium carbonate. These had previously been conditioned at 97% relative humidity and this humidity was maintained by confining the piles to sealed plastic bags while the piles were pressed at 50 psi. Piles were removed from the pressure at various times and the acidic sheets were evaluated by the described techniques. The results are shown in FIG. 3. The initial acid content was 66 meq/kg. After one day, the sheets were (in order of closeness to the alkaline sheet) 12, 23 and 29 meq/kg in acid content. After 4 days, all sheets had acid contents of about 10 meq/kg and a salt pH of about 6.3. This example demonstrates that the alkaline sheets in our process need not necessarily be placed alternately in a paper document but may, for example, be inserted after every six pages. Clearly, if the alkaline sheets are placed less frequently, deacidification of all the sheets will take longer.

EXAMPLE 6

Figure 4:
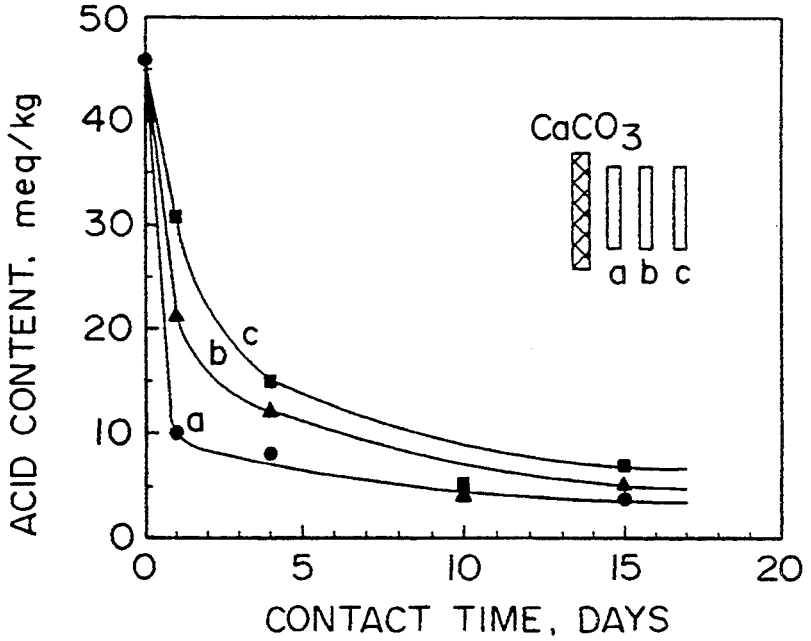
FIG. 4 demonstrates graphically the deacidification of a pile of three handsheets of unbleached kraft pulp by one alkaline sheet (RH 97%, 50 psi).

Example 5 was repeated using handsheets of unbleached kraft with an initial acid content of 46 meq/kg. As shown in FIG. 4, the sheets deacidified in a manner similar to those of Example 4 but it took 10 days rather than 4 days for the three sheets to deacidify to the same extent. This example confirms the applicability of the process features suggested in Example 5 to other kinds of paper but illustrates that times of treatment will vary somewhat from paper to paper.

EXAMPLE 7

Sheets of a commercial coated newsprint and handsheets of chemi-thermomechanical pulp were treated by the deacidification process described in Example 5. Along with the newsprint of Example 5, surface pH was measured, before treatment, immediately after treatment, and two months after treatment, the results are shown in Table I below.

The results further confirm wide applicability of the treatment and demonstrate that, unlike the results obtained by Barrow, see above, using ammonia for neutralization, the deacidification is stable after two months storage of the treated samples at room humidity.

TABLE I

Test of the permanence of the deacidification treatment

| | News-print | Coated Newsprint | CTMP Handsheets |
|---|---|---|---|
| Surface pH (initial) | 4.7 | 4.7 | 3.8 |
| Surface pH (after treatment) | 7.0 | 7.6 | 7.2 |
| Surface pH (two months after completion of treatment) | 7.1 | 7.3 | 7.1 |

EXAMPLE 8

Figure 5:
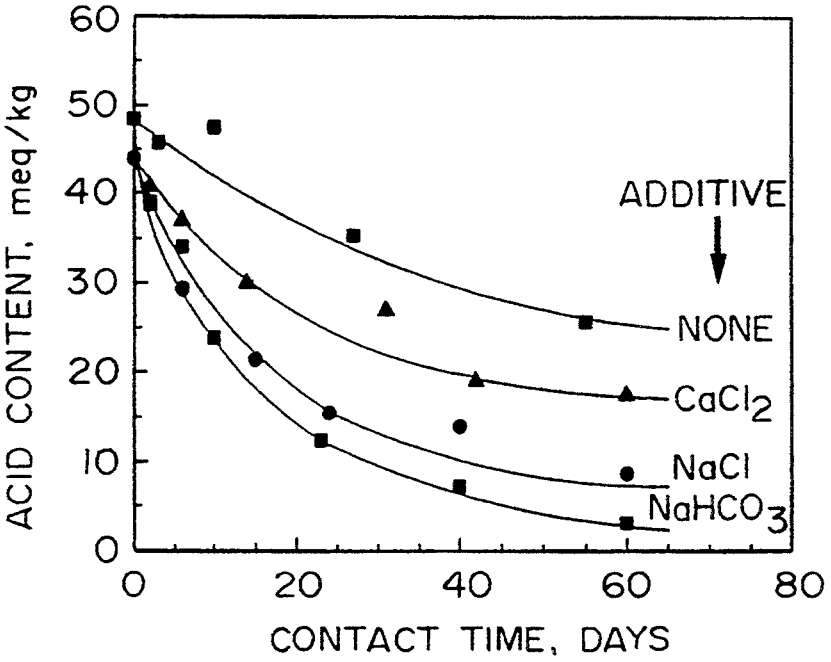
FIG. 5 demonstrates graphically the deacidification of handsheets of unbleached kraft pulp by alkaline sheets to which small amounts of various salts have been added (RH 85%, 1 psi, 2 side contact).

Piles of sheets were prepared, each pile consisting of a handsheet of unbleached kraft pulp sandwiched between two sheets of commercial paper containing 20% calcium carbonate. Prior to setting up the piles, the alkaline sheets were dipped in a solution of a salt and were then blotted, a treatment estimated to put 100 meq/kg of salt into each sheet, and dried. These sheets and the kraft sheets were then conditioned at 85% relative humidity and this humidity was maintained by confining each pile to a sealed plastic bag. The piles were then pressed at a pressure of 1 psi. At various times sheets were removed from the piles and the progress of deacidification evaluated. The results given in FIG. 5 show that deacidification (relatively slow at 1 psi and 85% relative humidity in the example given) can be speeded up by the addition of electrolytes and soluble alkalies to the treatment sheets.

EXAMPLE 9

Pile of sheets was constructed of two sheets of commercial newsprint between two sheets of paper containing 20% calcium carbonate. All sheets were previously conditions to 97% relative humidity and this humidity was maintained while the sheets were pressed at 2 psi. The colour change of pH indicator papers interleaved between the two newsprint sheets (this is a simple way of monitoring the process) showed substantial deacidification after 12 days. The salt pH was subsequently measured and found to have risen from 4.0 to 6.2.

Figure 6:
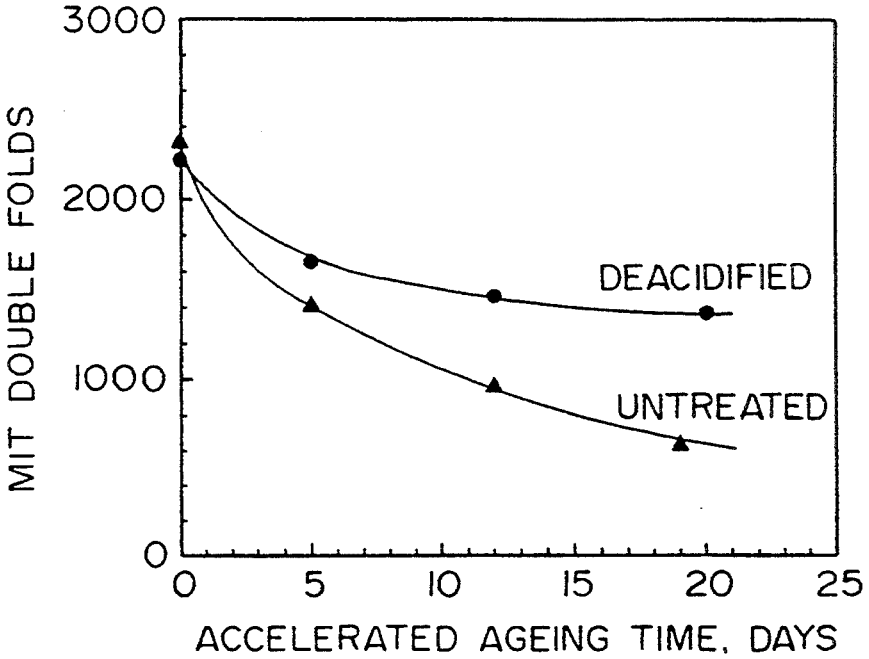
FIG. 6 demonstrates graphically the loss of folding strength under accelerated ageing conditions of samples of newsprint before and after deacidification.

Untreated and treated newsprint were then subjected to 20 days of accelerated ageing by exposure to an atmosphere at 80 deg C and a relative humidity of 75%. Various paper properties were measured and found to show that improved permanence had resulted from the deacidification. FIG. 6, for example, shows that the folding strength of the treated paper deteriorated at a much lower rate than that of the untreated paper.

EXAMPLE 10

The deacidification treatment of Example 9 was repeated by inserting carbonate sheets in a paperback book after every two pages. The pages of the book, published in 1962, had a salt pH of 3.7. After 8 weeks at a relative humidity of 97% and under a pressure of 2psi, the salt pH was found to be 6.9.

EXAMPLE 11

A deacidification of pages from a second paperback book was carried out by alternating the pages with sheets of commercial paper containing 20% calcium carbonate. All sheets had previously been conditioned at 97% RH and this humidity was maintained while the pile was pressed at 50 psi. Sheets were removed and evaluated at various times. The pages of the book (published in 1971) had an initial acid content of 109 meq/kg and a salt pH of 4.0. After one day the acid content had dropped to 30 meq/kg and the salt pH had risen to 6.1. After 15 days, the acid content was 5 meq/kg and the salt pH was 7.1.

EXAMPLE 12

Samples of the unbleached kraft paper deacidified by contact with a commercial paper containing calcium carbonate and added calcium chloride as described in Example 8 were analysed for sodium and calcium ions. As shown in Table II, below, deacidification was accompanied by an increase in the concentration of calcium ions thus demonstrating the migration of ions from one sheet of paper to another.

TABLE II

Demonstration of the movement of calcium ions during deacidification.

| Time Days | Hydrogen Ions meq/kg | Calcium Ions meq/kg | Sodium Ions meq/kg |
|---|---|---|---|
| 0 | 44 | 17 | 18 |
| 2 | 41 | 22 | 20 |
| 6 | 37 | 29 | 20 |
| 14 | 30 | 52 | 19 |
| 31 | 27 | 72 | 18 |
| 42 | 19 | 94 | 16 |

EXAMPLE 13

A pile of sheets was constructed consisting of acidic unbleached kraft handsheets alternating with unbleached kraft handsheets containing 8% magnesium carbonate as a filler. The sheets were previously conditioned at 97% RH and this humidity was maintained while the sheets were pressed at 1 psi. The acid content of the unfilled sheets was reduced from 38 meq/kg to 0.4 meq/kg after 10 days contact thus indicating the effectiveness of magnesium carbonate sheets in bringing about deacidification.

EXAMPLE 14

The upper surface of a sheet of newsprint with a surface pH of 4.7 was dusted with precipitated calcium carbonate and was then covered with a second sheet of newsprint. A pH indicator paper was placed above this pile and a second one was placed below. The materials had previously been conditioned at 97% RH and this was maintained while the pile was pressed at 10 psi. The indicator papers indicated an acid pH after 24 hours but changed colour after 3 days indicating an alkaline pH. This example demonstates that, in addition to alkaline sheets, alkaline powders may be used to bring about deacidification.

EXAMPLE 15

The experiment of Example 14 was repeated using powdered sodium bicarbonate in place of calcium carbonate. The indicator paper turned alkaline after twenty-four hours.

EXAMPLE 16

The experiment of Example 14 was repeated but using three sheets of newsprint on each side of the calcium carbonate powder. The indicator paper turned to an alkaline pH after 5 days. The sandwich was dismantled and the salt pH of the outer layer of newsprint was measured at 6.6.

We claim:

1. A process for deacidifying acidic papers comprising:

holding at least one acidic paper in an assembly with a source of an alkaline solid, said assembly being under a mechanical pressure of at least 0.01 psi and at an elevated humidity effective to promote migration of ions between said solid and the acid of said paper.

2. A process according to claim 1, wherein said at least one acid paper comprises a plurality of paper sheets.

3. A process according to claim 1, wherein said at least one acid paper comprises a plurality of pages in a book.

4. A process according to claim 1, wherein said alkaline solid is present in said assembly as a powder, said at least one acidic paper comprising first and second acidic papers, and said powder being held between said first and second acidic papers.

5. A process according to claim 4, wherein said powder is a fine powder of calcium carbonate, magnesium carbonate or sodium bicarbonate.

6. A process according to claim 1, wherein said alkaline solid, is contained in a paper sheet.

7. A process according to claim 6, wherein said alkaline solid is selected from the group consisting of alkali metal carbonates, alkaline earth metal carbonates, alkali metal bicarbonates and alkaline earth metal bicarbonates.

8. A process according to claim 6, wherein said alkaline solid is calcium carbonate.

9. A process according to claim 6, wherein said relative humidity is at least 75% and said mechanical pressure is at least 0.1 psi.

10. A process according to claim 6, wherein said holding is for 1 to 40 days.

11. A process according to claim 6, wherein said source comprises at least 0.1%, by weight, of the paper sheet, of said alkaline solid, and said mechanical pressure is at least 1 psi.

12. A process according to claim 6, wherein said paper sheet further contains an electrolyte salt.

13. A process according to claim 12, wherein said electrolyte salt is sodium chloride or calcium chloride.

14. A process for deacidifying acidic paper sheets and acidic pages of books comprising:

interleaving an assembly of the acidic paper sheets or acidic pages with a source of an alkaline solid, and holding said assembly at an elevated humidity and under mechanical pressure of at least 0.01 psi for a period of time to permit migration of ions between said alkaline solid and the acid of said acidic paper sheets or pages thus neutralizing the acid of said acidic paper sheets or papers.

15. A process according to claim 14, wherein said humidity is at least 75% and said mechanical pressure is at least 0.1 psi.

16. A process according to claim 15, wherein said period of time is 1 to 40 days.

17. A process according to claim 14, wherein said source comprises a paper sheet containing said alkaline solid.

18. A process according to claim 17, wherein said alkaline solid is selected from the group consisting of calcium carbonate, magnesium carbonate and mixtures thereof.

19. A process according to claim 17, wherein said alkaline solid is sodium bicarbonate.

20. A process according to claim 17, wherein said paper sheet comprising said source further contains an electrolyte salt.

21. A process according to claim 29, wherein said salt is sodium chloride or calcium chloride.

22. A process according to claim 17, wherein pH indicator papers are inserted in said assembly to monitor the progress of deacidification.

23. A process according to claim 17, wherein said source comprises at least 0.1%, by weight, of the paper sheet, alkaline solid, and said humidity is greater than 90%.

24. A deacidification paper sheet containing at least 0.1%, by weight, of an alkaline solid, and further containing an electrolyte salt.

25. A paper according to claim 24, wherein said salt is sodium chloride or calcium chloride.

* * * * *